US009622005B2

(12) United States Patent
Wang et al.

(10) Patent No.: US 9,622,005 B2
(45) Date of Patent: Apr. 11, 2017

(54) PLASTIC FRAME AND SOUND TRANSDUCER USING THE SAME

(71) Applicants: ChangLiang Wang, Shenzhen (CN); BiMing Zhang, Shenzhen (CN)

(72) Inventors: ChangLiang Wang, Shenzhen (CN); BiMing Zhang, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 127 days.

(21) Appl. No.: 14/582,378

(22) Filed: Dec. 24, 2014

(65) Prior Publication Data

US 2015/0195632 A1 Jul. 9, 2015

(30) Foreign Application Priority Data

Jan. 6, 2014 (CN) ..... 2014 2 0006153 U

(51) Int. Cl.
*H04R 31/00* (2006.01)
*H04R 9/02* (2006.01)
*H04R 9/06* (2006.01)

(52) U.S. Cl.
CPC ..... *H04R 31/006* (2013.01); *H04R 9/025* (2013.01); *H04R 9/06* (2013.01)

(58) Field of Classification Search
CPC ..... H04R 31/006; H04R 9/06; H04R 9/02; H04R 1/02; H04R 1/06
See application file for complete search history.

(56) References Cited

U.S. PATENT DOCUMENTS 5,583,945 A * 12/1996 Iijima ..... H04R 9/06 381/386
9,369,807 B2 * 6/2016 Jiang ..... H04R 9/046
2004/0218779 A1 * 11/2004 Fukuyama ..... H04R 1/06 381/409
2005/0013460 A1 * 1/2005 Hungerford ..... H04R 1/02 381/386
2006/0139563 A1 * 6/2006 Momose ..... G02F 1/134336 349/190
2012/0170791 A1 * 7/2012 Meng ..... H04R 9/02 381/386
2015/0181344 A1 * 6/2015 Jiang ..... H04R 9/046 381/400

* cited by examiner

*Primary Examiner* — Md S Elahee
*Assistant Examiner* — Angelica M McKinney
(74) *Attorney, Agent, or Firm* — Na Xu; IPro, PLLC

(57) ABSTRACT

A sound transducer is disclosed. The sound transducer includes a plastic frame having a cavity and a wall surrounding the cavity, the wall having an inside surface face toward the cavity and an outside surface opposite to the inside surface, a number of sinks disposed on the inside surface of the plastic frame in a row, a yoke located in the cavity and including a sidewall for contacting with the plastic frame, a gap formed by the sink cooperatively with the sidewall of the yoke, and bonding adhesive located in the gap for fixing the yoke in the frame firmly.

3 Claims, 3 Drawing Sheets

PLASTIC FRAME AND SOUND TRANSDUCER USING THE SAME

RELATED PATENT APPLICATIONS

This application claims the priority benefit of Chinese Patent application Filing Serial Number CN 201420006153.2, filed on Jan. 6, 2014, the disclosure of which is herein incorporated by reference in its entirety.

FIELD OF THE INVENTION

The present disclosure generally relates to transducers to be mounted in terminal equipment for converting electrical signals to audible sounds, and more particularly to an plastic frame and sound transducer using the same.

DESCRIPTION OF RELATED ARTS

With the rapid development of the portable devices such as cellular phones, people request for more and more functions. In the field of music enjoying of the cellular phone, a multifunction device enabling providing both audible and tactile sensations for amusement has already been widely used, which boosts the quick development of multifunctional devices.

An electromagnetic speaker is used in many types of portable electronic devices such as two-way radio transceivers for transducing speech and providing audible sounds. A transducer related to the present disclosure comprises a bracket, a magnetic circuit part received in the bracket, and an assistant part connecting to the bracket. The magnetic circuit part includes a single magnet and a single magnetic frame corporately forming a magnetic circuit. The magnetic frame is assembled with the assistant part so that the magnetic circuit part is suspended in the bracket by the assistant part. In recent years, it has been the market tendency to make electronic apparatus thinner and smaller and to provide electronic telecommunication apparatus with user-friendly operation interfaces. A vibrating member for providing tactile sensation in the electromagnetic transducer needs sufficient vibration amplitude for ensuring good performance.

Related transducer includes a bracket and a magnetic bowl received in the bracket. The bracket forms a plurality of slots for accommodating glue further for positioning the magnetic bowl. Generally, the slot is a cuboid and the opening thereof has a width same to that of the bottom. Inner surfaces of the slot are smooth. Glue cannot be completely filled in the slot having such a configuration. Further, UV light cannot enter the slot smoothly, which badly affects the strength of the combination of the glue in the slot and the magnetic bowl.

So, it is necessary to provide a new plastic frame and sound transducer using the same for solving the problems mentioned above.

BRIEF DESCRIPTION OF THE DRAWINGS

Many aspects of the embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EXEMPLARY EMBODIMENT

Figure 1:
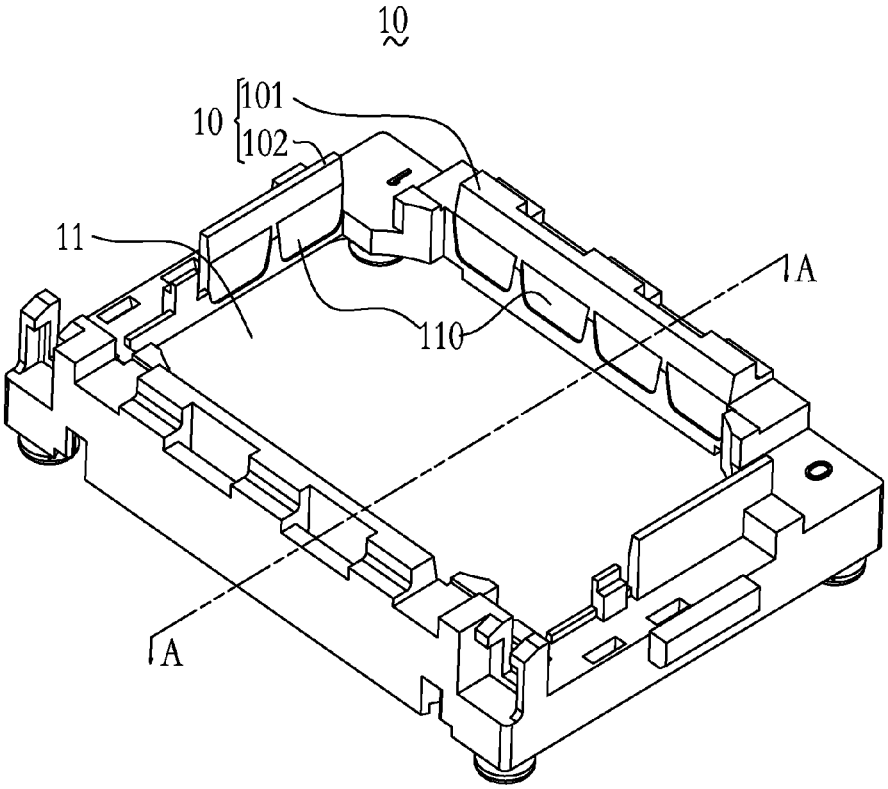
FIG. 1 is an isometric view of a frame of a transducer in accordance with an exemplary embodiment of the present disclosure.

While the invention is susceptible of embodiment in many different forms, there is shown in the drawings and will herein be described in detail embodiment of the invention with the understanding that the present disclosure is to be considered as an exemplification of the principles of the invention and is not intended to limit the broad aspect of the invention to the embodiment illustrated.

Generally, A related speaker comprises a frame, a magnetic circuit part having a yoke positioned in the frame, a pole plate and a magnet disposed in the yoke, a diaphragm supported by the frame, a voice coil directly or indirectly attached to the diaphragm, and a cover pressing on a peripheral portion of the diaphragm. For electrically connecting the speaker to an external PCB, a plurality of terminals is provided and is connected to leads of the voice coil. When alternating currents go through the voice coil, the magnet will drive the voice coil to vibrate and the diaphragm will also vibrate with the voice coil accordingly, which converts the currents into sound waves.

Referring to FIG. 1, a frame 10 is illustrated in accordance with an exemplary embodiment of the present disclosure. The frame 10 may be used in a speaker, or other transducers according to actual requirements. In the embodiment, the frame 10 includes a cavity 11 and a rectangular portion surrounding around the cavity 11 for holding a components, such as a yoke or something else. The rectangular portion has two long-walls 101 and two short-walls 102 forming a loop-shaped portion. The shape of the frame 10 is not restricted to be rectangular as described in this embodiment. The frame may be an oblong corresponding to the component ready to be accommodated therein. In the present embodiment, the frame 10 has an inside surface 10*a* toward the yoke and an outside surface 10*b* opposite to the inside surface 10*a*. A plurality of sinks 110 are disposed in the inside surface 10*a* of the frame 10 in a row along a direction parallel to the rectangular portion in a plan view.

Figure 2:
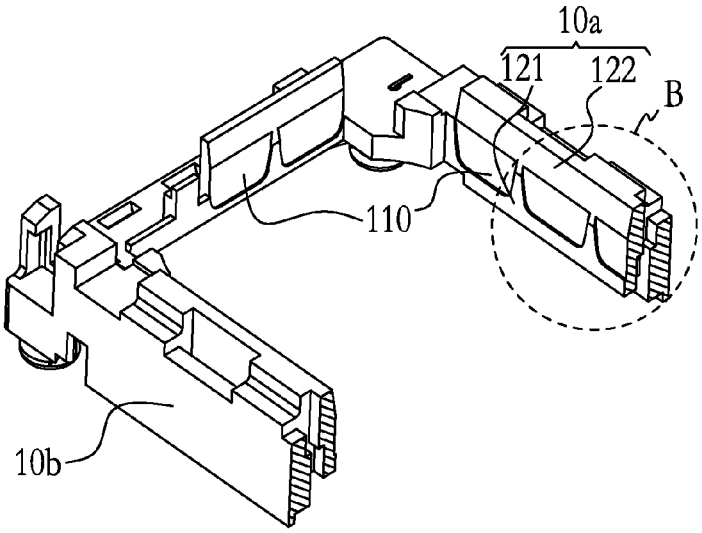
FIG. 2 is a cross-sectional view of the frame taken along line A-A in FIG. 1.
Figure 3:
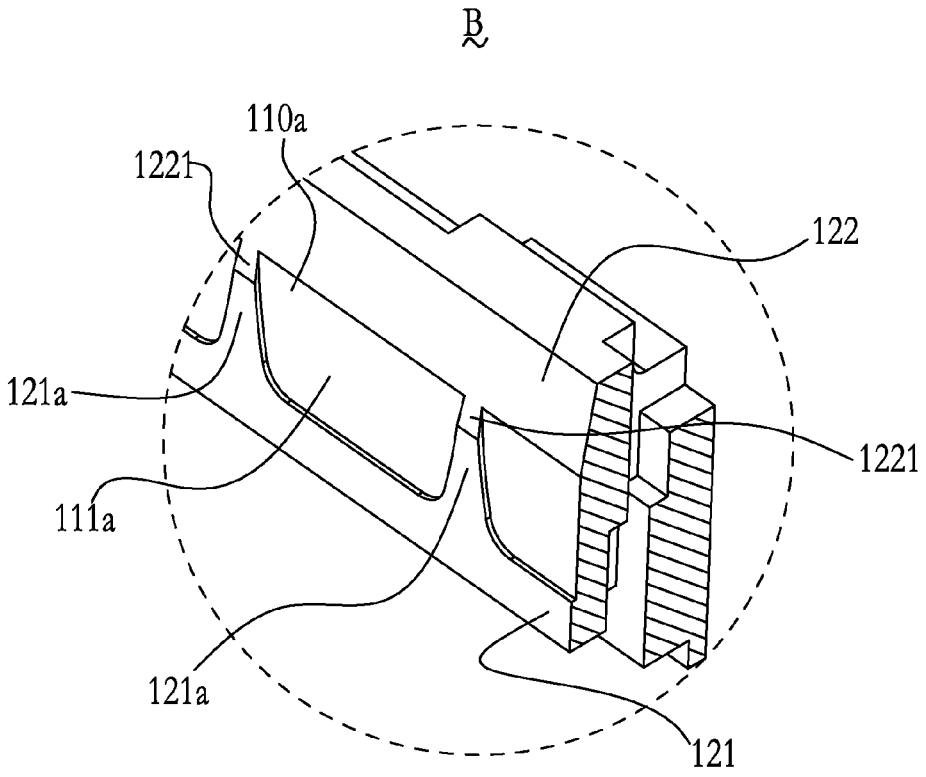
FIG. 3 is an enlarged view of part B in FIG. 2.

Referring to FIG. 2, the inside surface 10*a* of the frame 10 includes a first surface 121 and a second surface 122 connected with the first surface 121. The plurality of sinks 110 are spaced apart each other which are provided on the first surface 121. The first surface 121 is substantially perpendicular to the rectangular portion in a plan view, and the second surface 122 extends from the first surface 121 along an outward inclined direction for assembling other components easily. That is to say, the second surface 122 is farther away from the cavity 11 than the first surface 121 for guiding the other components fixed in the cavity 11 easily. Specifically, referring to FIG. 3, the second surface 122 further has a plurality of guiding surfaces 1221 located between two adjacent sinks and extending toward the first surface 121. The sink has a first part 110*a* provided on the second surface 122 and a second part 111*a* provided on the first surface 121. Since the plurality of sinks 110 are spaced apart each other in a row, a clapboard 121*a* of the first portion 121 is provided between two sinks and connecting with the guiding surfaces 1221.

Figure 4:
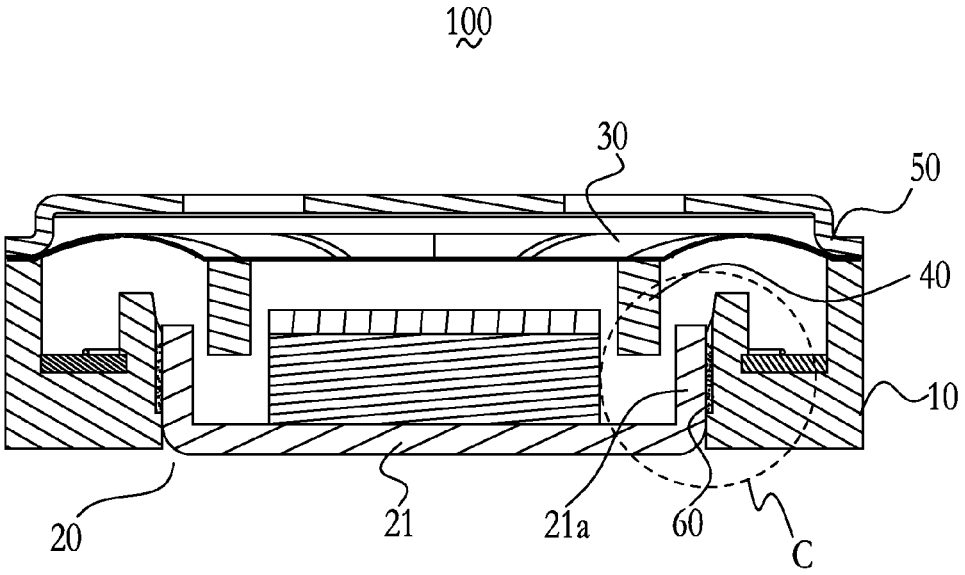
FIG. 4 depicts an assembled view of the frame and a yoke.
Figure 5:
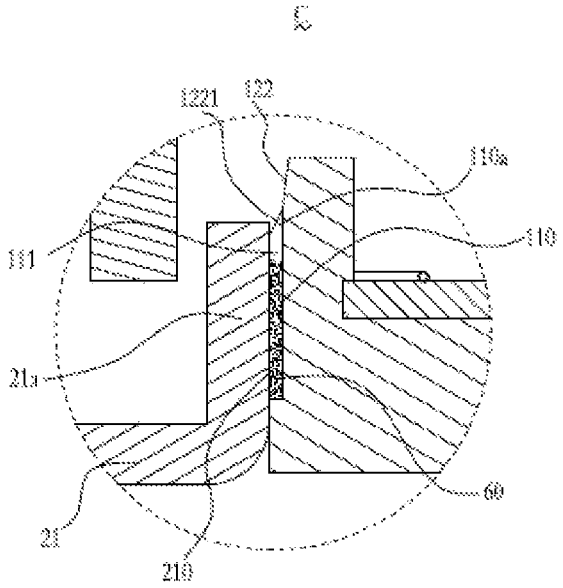
FIG. 5 is an enlarged view of part C in FIG. 4.

Referring to FIGS. 4-5, the frame 10 in accordance with an exemplary embodiment of the present invention is assembled with other components in a speaker 100. The speaker 100 has a magnetic circuit 20 including a yoke 21, a diaphragm 30 for generating sound, a voice coil 40 for driving the diaphragm 30, and a lid 50. The yoke 21 is configured to be like a bowl and has a sidewall 21*a* for assembling with the frame 10. Concretely saying, the sidewall 21*a* of the yoke 21 has an outward surface 210 coupled with the inner surface 10*a* of the frame 10. When the yoke 21 is assembled in the frame 10, a gap 111 is accordingly formed by the outward surface 210 of the yoke 21 cooperatively with the sink 110 for remaining adhesive. That is to say, bonding adhesive 60 is filled in the gap 111 so as to fix the yoke 21 in the frame 10 firmly.

Figure 6:
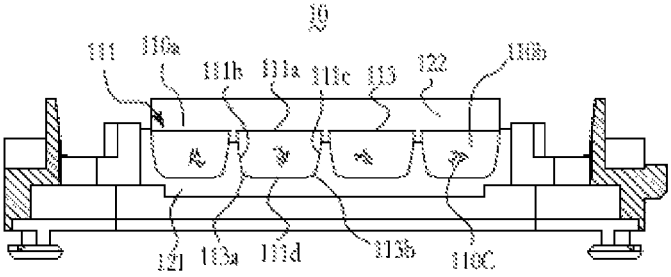
FIG. 6 is a top view of a sink of the frame in FIG. 1.

Furthermore, referring to FIG. 6, the configuration of the gap 111 is designed to be a pocket in a plan view in this embodiment and includes a straight end 111*a* designed at the outlet 110*a* and three arc-shaped sides 111*b*, 111*c*, 111*d* forming a loop-shaped portion 113. Therefore, the loop-shaped portion 113 has at least two arc anglings 113*a*, 113*b* provided in proper position far away the outlet 110*a*. When the bonding adhesive 60 in liquid form is painted into the pocket through the outlet 110*a*, the bonding adhesive 60 may be flowing into the bottom of the gap 111 by virtue of gravitation down the two arc anglings 113*a-b* for gluing in the maximal degree. In this embodiment, the bonding adhesive 60 is ultraviolet ray glue which is solidified by UV ray. The sinks 110 have an adhesive surface 110*b* opposite to the outward surface 210 of the yoke 21. The adhesive surface 110*b* is designed a grained leather surface 110*c* by plastic injection process for remaining the more bonding adhesive 60. There, the term "grained leather" means a plurality of micro-scar provided on the adhesive surface 110*b* of the sinks 110 rather than a real animal skin.

While the present invention has been described with reference to a specific embodiment, the description of the invention is illustrative and is not to be construed as limiting the invention. Various of modifications to the present invention can be made to the exemplary embodiment by those skilled in the art without departing from the true spirit and scope of the invention as defined by the appended claims.

What is claimed is:

1. A plastic frame for a sound transducer, comprising:

a wall and a cavity surrounded by the wall for holding a component, the wall having an inside surface face toward the cavity and an outside surface opposite to the inside surface, the inside surface of the plastic frame including a first surface and a second surface connected with the first surface, the second surface extending obliquely from the first surface for assembling the component;

a plurality of sinks disposed in the inside surface of the plastic frame in a row and spaced from each other for remaining adhesive so as to glue the component, each of the sinks having a first part provided in the second surface and a second part disposed in the first surface;

the second surface further having a plurality of guiding surfaces located between two adjacent sinks and extending toward to the first surface, wherein each sink includes a straight end in the first part and three arc-shaped sides forming a loop-shaped portion, and at least two arc anglings are provided in proper position far away from the first part; wherein each sink has an adhesive surface which is designed to be a grained leather surface by plastic injection process.

2. A sound transducer, comprising:

a plastic frame having a cavity and a wall surrounding the cavity, the wall having an inside surface face toward the cavity and an outside surface opposite to the inside surface, a plurality of sinks disposed in the inside surface of the plastic frame in a row and spaced from each other, the inside surface of the plastic frame further including a first surface and a second surface connected with the first surface, the second surface obliquely extending from the first surface, the second surface having a plurality of guiding surfaces located between two adjacent sinks and extending toward to the first surface, each sink further including a first part provided in the second surface and a second part provided in the first surface;

a yoke provided in the cavity and including a sidewall for contacting with the plastic frame;

a gap formed by the sink cooperatively with the sidewall of the yoke;

a bonding adhesive located in the gap for fixing the yoke in the plastic frame firmly;

wherein each sink includes a straight end designed at the first part and three arc-shaped sides forming a loop-shaped portion, and at least two arc anglings are provided in proper position far away from the outlet; wherein each sink has an adhesive surface which is designed to be a grained leather surface by plastic injection process.

3. The Plastic frame as described in claim 2, wherein the bonding adhesive is ultraviolet ray glue which is solidified by UV ray.

* * * * *